US007462128B2

(12) United States Patent
Uchiyama et al.

(10) Patent No.: US 7,462,128 B2
(45) Date of Patent: Dec. 9, 2008

(54) ROLLING ELEMENT AND A PROCESS FOR PRODUCING THE ROLLING ELEMENT

(75) Inventors: Noriko Uchiyama, Kanagawa (JP); Keizo Otani, Kanagawa (JP); Mitsuhiro Okuhata, Kanagawa (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 743 days.

(21) Appl. No.: 11/137,398

(22) Filed: May 26, 2005

(65) Prior Publication Data

US 2006/0058152 A1 Mar. 16, 2006

(30) Foreign Application Priority Data

May 27, 2004 (JP) ..... 2004-157028

(51) Int. Cl.
*F16H 55/32* (2006.01)

(52) U.S. Cl. ..... 476/72; 476/73; 476/42; 384/492; 384/625

(58) Field of Classification Search ..... 476/40, 476/42, 67, 72, 73; 384/492, 625, DIG. 9
See application file for complete search history.

(56) References Cited

U.S. PATENT DOCUMENTS

| | | | | |
|---|---|---|---|---|
| 5,150,974 | A | 9/1992 | Tamada et al. | |
| RE35,860 | E * | 7/1998 | Ward | 384/492 |
| 6,051,080 | A * | 4/2000 | Kino et al. | 148/319 |
| 6,565,477 | B2 * | 5/2003 | Yoshida et al. | 476/40 |
| 6,814,685 | B2 | 11/2004 | Hirai et al. | |
| 2002/0039949 | A1 | 4/2002 | Itoh et al. | |
| 2003/0165279 | A1 | 9/2003 | Hirai et al. | |
| 2003/0169955 | A1 * | 9/2003 | Hirai et al. | 384/625 |

FOREIGN PATENT DOCUMENTS

| | | |
|---|---|---|
| DE | 100 84 447 T1 | 6/2002 |
| EP | 1 199 495 A2 | 4/2002 |
| EP | 1 312 817 A2 | 5/2003 |
| JP | 63-088321 A | 4/1988 |
| JP | 02-190615 A | 7/1990 |
| JP | 06-313434 A | 11/1994 |

OTHER PUBLICATIONS

Japanese Industrial Standard, "Surface Roughness—Definitions and Designation", JIS B 0601, 1994, pp. 1-25.
Japanese Industrial Standard, "Surface Texture—Instruments for the Assessment of Surface Texture—Profile Method", JIS B 0651, 1996, pp. 1-19.

* cited by examiner

*Primary Examiner*—David M Fenstermacher
(74) *Attorney, Agent, or Firm*—Foley & Lardner LLP

(57) ABSTRACT

A rolling element including a base metal, and a nickel coat formed on a surface of the base metal and cooperating with the base metal to constitute a rolling contact surface satisfying condition that a mean value of ratios of L1 to L2 as measured in at least three optional observation areas is in a range of from 1.2 to 2.4, where each observation area is disposed in a cross section taken in a vertical direction relative to the surface of the base metal and is defined by two parallel vertical lines; lengths L1 and L2 respectively represent a length of an interface between the base metal and the nickel coat, and a length of a reference line segment extending perpendicular to the vertical direction, in same observation area.

23 Claims, 4 Drawing Sheets

ROLLING ELEMENT AND A PROCESS FOR PRODUCING THE ROLLING ELEMENT

BACKGROUND OF THE INVENTION

The present invention relates to a rolling element for use in a rolling member and a bearing which constitute a toroidal continuously variable transmission (CVT) for automobiles, a bearing constituting an engine driving auxiliary machinery such as a fuel pump, an alternator and an air compressor, or a bearing for an air compressor, a gear and a bearing for a transmission, and relates to a process for producing the rolling element. More specifically, this invention relates to a rolling element which is improved in rolling-fatigue strength and significantly prevents short-life peeling or flaking due to hydrogen-induced embrittlement that will be caused when hydrogen generated by decomposition of a lubricating oil during rolling of the rolling element penetrates into a metal material of the rolling element, and a process for producing the rolling element.

U.S. Pat. No. 5,510,974, corresponding to Japanese Patent Application First Publication No. 2-190615, describes a grease-sealed bearing aiming at suppressing hydrogen infiltration into races of the bearing, namely, the short-life peeling or flaking due to hydrogen-induced embrittlement as described above. The races have triiron tetroxide layers on the rolling surfaces which are formed by blackening treatment to thereby restrain the occurrence of flaking on the bearing surfaces and improve lives of the bearing.

Japanese Patent Application First Publication No. 6-313434 describes a corrosion resistant rolling bearing in which a nickel plating layer is formed on a surface of at least one of an inner race, an outer race, rolling members and a retainer for the rolling members. This technology contemplates to improve corrosion resistance under the severe corrosive environment such as salt water spraying and enhance the plating ability.

SUMMARY OF THE INVENTION

In general, the toroidal CVT includes an input disk, an output disk and power rollers contacted with the input and output disks via a lubricating oil. The disks and the power rollers have rolling contact surfaces coming into rolling contact with each other via the lubricating oil. Rotation of the input disk is transmitted to the output disk by the traction drive produced between the rolling contact surfaces of the disks and the power rollers. When the toroidal CVT is driven, a high loading force is applied to the rolling contact surfaces of the input and output disks and the rolling contact surfaces of the power rollers. This will cause a high contact surface pressure exerted on bearing groove surfaces of the inner and outer races of each power roller which define grooves receiving rolling members and are in rolling contact with the rolling members. Specifically, the maximum contact surface pressure exerted on the bearing groove surfaces of the inner and outer races may reach more than 3 GPa. Further, traction force and radial load are applied onto the bearing groove surfaces of the races of the power roller when the rolling members roll on the bearing groove surfaces. This may cause microscopic metal-to-metal contact between the bearing groove surfaces and the rolling members or increase rolling-friction resistance generated therebetween, whereby tangential force applied onto the rolling surfaces will become large so that rolling-fatigue lives of the races will be lowered.

In addition, it is known that a grease-lubricating bearing tends to be affected by the tribochemical reaction caused between the grease and the rolling contact surfaces of the races coming into contact with a plurality of rolling members via grease. The tribochemical reaction will be promoted by a catalytic action of the neo-surface that is newly produced on the rolling contact surface by the microscopic metal-to-metal contact between the rolling contact surfaces and the rolling members. This will cause chemical decomposition of the grease, resulting in the production of hydrogen. The hydrogen produced will infiltrate into the metal structure of the races to thereby deteriorate the rolling-fatigue lives thereof.

In order to eliminate the above-described problem of the grease-lubricating bearing, there has been proposed the blackening treatment as disclosed in the above-described earlier technique. In the blackening treatment, the races are immersed in a caustic soda solution heated at a temperature of 130° C.-160° C. This will make adverse influence on working environment and therefore it is industrially undesirable. Further, the triiron tetroxide layers formed by the blackening treatment will not sufficiently remain on the rolling contact surfaces under the severe conditions such as high temperature and high contact surface pressure. Therefore, it will not be assured to suppress the hydrogen infiltration into the metal structure of the races. Further, in a case where the rolling contact surfaces of the races are coated with a nickel layer, the nickel layer will be wear out with passage of a relatively short time depending upon the coating direction or the coating characteristic under the severe conditions such as high temperature and high contact surface pressure. In this case, the hydrogen infiltration into the metal structure of the races and the microscopic metal-to-metal contact between the rolling contact surfaces and the rolling members cannot be sufficiently prevented.

There is a demand to solve the above-described problems in the earlier technologies. An object of the present invention is to provide a rolling element that is free from the neo-surface production caused by the microscopic metal-to-metal contact for a long time and therefore suppresses the hydrogen infiltration into the metal structure of the rolling element, by forming a protection coat capable of preventing hydrogen from infiltrating therethrough into the metal structure of the rolling element so as to be improved in rolling-fatigue life. Specifically, the object of the present invention is to provide a long-life rolling element that can be prevented from suffering from the short-life flaking due to the hydrogen-induced embrittlement which is caused by infiltration of the hydrogen generated by chemical decomposition of a lubricating oil upon rolling of the rolling element, into the metal structure of the rolling element, and can maintain the performance for a long period of use. It is another object of the present invention to provide a process for producing the rolling element having such function and effect as described above. Still other objects and features of this invention will become understood from the following description with reference to the accompanying drawings.

According to one aspect of the present invention, there is provided a rolling element having a rolling contact surface coming into rolling contact with a counterpart, the rolling element comprising:

a base metal; and a nickel coat formed on a surface of the base metal and cooperating with the base metal to constitute the rolling contact surface, wherein the rolling contact surface satisfies condition that a mean value of ratios of L1 to L2 as measured in at least three optional observation areas is in a range of from 1.2 to 2.4, where each of the at least three optional observation areas is disposed in a cross section taken in a vertical direction relative to the surface of the base metal covered with the nickel coat and is defined by two parallel lines extending in the vertical direction; L1 represents a length of an interface between the base metal and the nickel coat in each of the at least three optional observation areas; and L2 represents a length of a reference line segment extending perpendicular to the vertical direction in each of the at least three optional observation areas, L1 and L2 being present in same observation area.

According to a further aspect of the present invention, there is provided a process for producing a rolling element having a rolling contact surface coming into rolling contact with a counterpart, the process comprising:

forming a nickel coat on a surface of a base metal of a workpiece; and subjecting the workpiece formed with the nickel coat on the surface of the base metal to baking at a temperature of not more than 200° C. to provide the rolling element having the rolling contact surface, wherein the rolling contact surface satisfies condition that a mean value of ratios of L1 to L2 as measured in at least three optional observation areas is in a range of from 1.2 to 2.4, where each of the at least three optional observation areas is disposed in a cross section taken in a vertical direction relative to the surface of the base metal covered with the nickel coat and is defined by two parallel lines extending in the vertical direction; L1 represents a length of an interface between the base metal and the nickel coat in each of the at least three optional observation areas; and L2 represents a length of a reference line segment extending perpendicular to the vertical direction in each of the at least three optional observation areas, L1 and L2 being present in same observation area.

DETAILED DESCRIPTION OF THE INVENTION

Figure 1:
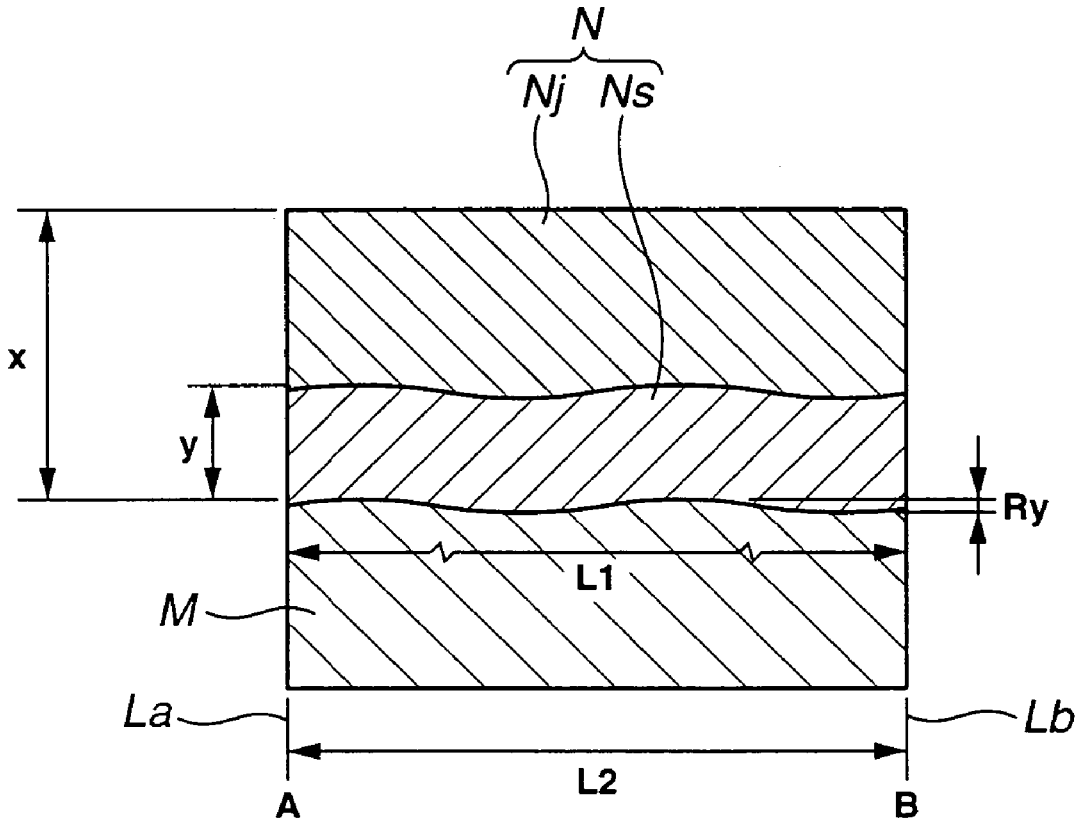
FIG. 1 is an explanatory diagram showing a sectional observation area of a rolling element of a preferred embodiment, according to the present invention.

Referring now to FIG. 1, a rolling element of a first embodiment, according to the present invention is explained. The rolling element of this embodiment has a rolling contact surface coming into rolling contact with a counterpart. FIG. 1 illustrates a cross section of the rolling contact surface, taken in a vertical direction relative to a surface of base metal M of the rolling contact surface, namely, in an up-and-down direction as viewed in FIG. 1. As shown in FIG. 1, the rolling element includes base metal M and nickel coat N formed on a surface of base metal M. Base metal M and nickel coat N cooperate with each other to constitute the rolling contact surface. The rolling contact surface satisfies condition that a mean value of ratios L1/L2 of L1 to L2 as measured in at least three optional observation areas is in a range of from 1.2 to 2.4. Specifically, each of the at least three optional observation areas is given by observation at a magnification of 10000 using a scanning electron microscope (SEM). The observation area is defined by two parallel lines La and Lb that extend in the vertical direction relative to the surface of base metal M covered with nickel coat N and pass through opposite ends A and B of the reference line segment. L1 represents a length of an interface between base metal M and nickel coat N in each of the observation areas. L2 represents straight-line length of a reference line segment extending perpendicular to the vertical direction relative to the surface of base metal M covered with nickel coat N in each of the observation areas. Length L2 of the reference line segment is 11.5 μm in this embodiment. When the ratios L1/L2 are measured, length L1 and length L2 present in the same observation area are used.

If the mean value of the ratios L1/L2 is less than 1.2, adhesion strength of nickel coat N will become insufficient, so that nickel coat N will be worn before nickel is almost diffused into the surface of base metal M on which nickel coat N is formed. This causes almost no formation of a nickel diffusion layer that serves for suppressing hydrogen infiltration into base metal M. Therefore, the rolling element cannot provide a stable quality required for sufficiently exhibiting the effects of suppressing hydrogen infiltration and reducing microscopic metal-to-metal contact.

If the mean value of the ratios L1/L2 is more than 2.4, a surface roughness of base metal M appearing after nickel coat N is worn out will become large. This increases the metal-to-metal contact rate at a rolling contact portion of the rolling element, thereby causing softening of base metal M due to temperature increase at the rolling contact portion, and surface damage occurring at the rolling contact portions of the rolling element and the counterpart. This will result in deterioration of the rolling-fatigue life of the rolling element which is caused by the surface damage starting from an outermost area of the rolling contact portion. Therefore, if the mean value of the ratios L1/L2 is in the range of from 1.2 to 2.4, the adhesion strength of nickel coat N can be enhanced and the stable quality can be realized as explained later. Further, for the purpose of obtaining the more sufficient effects, the mean value of the ratios L1/L2 is preferably in a range of from 1.2 to 1.5.

In the rolling element of the first embodiment of the present invention, the length and area of the interface between base metal M and nickel coat N are increased, whereby the adhesion strength of nickel coat N relative to base metal M is enhanced. This can promote diffusion of nickel contained in nickel coat N into base metal M, thereby facilitating formation of a nickel diffusion layer as a protection coat preventing hydrogen from infiltrating therethrough into base metal M of the rolling element. Further, this can reduce neo-surface production caused by the microscopic metal-to-metal contact and suppress hydrogen infiltration into the inside structure of base metal M even in the severe conditions such as high temperature and high contact surface pressure. As a result, the rolling-fatigue life of the rolling element of the first embodiment can be improved. Especially, the short-life flaking due to the hydrogen-induced embrittlement which is caused by infiltration of the hydrogen generated by chemical decomposition of a lubricating oil during rolling of the rolling element, into base metal M of the rolling element, can be suppressed. This can significantly increase the rolling-fatigue life of the rolling element of the first embodiment and maintain the excellent property of nickel coat N for a long period of use. That is, the quality required to sufficiently perform the effects of suppressing the hydrogen infiltration and reducing the microscopic metal-to-metal contact, can be stabilized, and therefore, the rolling element of the first embodiment having a stable long-life can be obtained.

Further, it is preferred that maximum height Ry of the interface between base metal M and nickel coat N within the observation area as shown in FIG. 1 is in a range of from 0.05 μm to 1 μm. The measurement of maximum height Ry of the interface is carried out in accordance with JIS B 0601-1994 and JIS B 0651.

If maximum height Ry of the interface is less than 0.05 μm, the adhesion strength of nickel coat N relative to base metal M will become insufficient. In contrast, if maximum height Ry of the interface is more than 1 μm, a surface roughness of base metal M appearing after nickel coat N is worn out will become large. This increases the metal-to-metal contact rate at a rolling contact portion of the rolling element, thereby causing softening of base metal M due to temperature increase at the rolling contact portion, and surface damage occurring at the rolling contact portions of the rolling element and the counterpart. This will result in deterioration of the rolling-fatigue life of the rolling element which is caused by the surface damage starting from an outer-most area of the rolling contact portion.

In the rolling element of the first embodiment of the present invention, the interface between base metal M and nickel coat N is roughened such that the adhesion strength of nickel coat N relative to base metal M can be enhanced to thereby promote diffusion of nickel in nickel coat N into base metal M and facilitate forming a nickel diffusion layer contributing toward suppression of hydrogen infiltration. This can stabilize the quality required to perform the effects of suppressing the hydrogen infiltration and reducing the microscopic metal-to-metal contact.

Further, it is preferred that nickel coat N has a two-layered structure constituted of nickel strike plating layer Ns and outer nickel plating layer Nj formed on nickel strike plating layer Ns as shown in FIG. 1. With the formation of nickel strike plating layer Ns below outer nickel plating layer Nj, the adhesion strength of nickel coat N relative to base metal M can be enhanced to thereby promote diffusion of nickel in nickel coat N into base metal M and facilitate forming a nickel diffusion layer contributing toward suppression of hydrogen infiltration. This can stabilize the quality required to perform the effects of suppressing the hydrogen infiltration and reducing the microscopic metal-to-metal contact.

Further, it is preferred that minimum thickness x of nickel coat N within the observation area as shown in FIG. 1 is in a range of from 2 μm to 10 μm. If minimum thickness x of nickel coat N is less than 2 μm, the time elapsed before nickel coat N is worn-out and eliminated will become short, so that nickel in nickel coat N will not nearly be diffused into the surface of base metal M on which nickel coat N is disposed. Therefore, a nickel diffusion layer serving for suppressing hydrogen infiltration into base metal M will be hardly formed. The quality required for sufficiently exhibiting the effects of suppressing hydrogen infiltration and reducing microscopic metal-to-metal contact will become unstable. In contrast, if minimum thickness x of nickel coat N is more than 10 μm, the residual stress caused in nickel coat N will become excessively large as the thickness of nickel coat N will be increased. As a result, flaking of nickel coat N will occur in a relatively early stage of use. This cannot sufficiently contribute to improvement in the rolling-fatigue life of the rolling element.

In the rolling element in which minimum thickness x of nickel coat N within the observation area is in the range of from 2 μm to 10 μm, the time elapsed before nickel coat N is worn-out and eliminated will become sufficiently long, so that diffusion of nickel in nickel coat N into the surface of base metal M will be advanced. This allows formation of the nickel diffusion layer serving for suppressing hydrogen infiltration into base metal M. Therefore, the quality required for sufficiently exhibiting the effects of suppressing hydrogen infiltration and reducing microscopic metal-to-metal contact will become stable to thereby prolong the life of the rolling element.

Further, it is preferred that minimum thickness y of nickel strike plating layer Ns within the observation area as shown in FIG. 1 is 0.2 μm or more. If minimum thickness y of nickel strike plating layer Ns is less than 0.2 μm, the adhesion strength of nickel coat N relative to base metal M will become insufficient, so that nickel coat N will be worn before nickel in nickel coat N is diffused into the surface of base metal M on which nickel coat N is disposed. Therefore, a nickel diffusion layer serving for suppressing hydrogen infiltration into base metal M will be hardly formed. The quality required for sufficiently exhibiting the effects of suppressing hydrogen infiltration and reducing microscopic metal-to-metal contact will become unstable.

In the rolling element in which minimum thickness y of nickel strike plating layer Ns within the observation area is 0.2 μm or more, the adhesion strength of nickel coat N relative to base metal M can be enhanced to thereby promote diffusion of nickel in nickel coat N into base metal M and facilitate forming a nickel diffusion layer contributing toward suppression of hydrogen infiltration. This can further stabilize the quality required to perform the effects of suppressing the hydrogen infiltration and reducing the microscopic metal-to-metal contact.

The rolling element of the present invention can be applied to a rolling element and a bearing which constitute a toroidal CVT, a bearing for a belt-drive CVT, a gear and a bearing which constitute an engine driving auxiliary machinery such as a fuel pump, an alternator and an air compressor, and a gear and a bearing which are used in a transmission. The rolling element of the present invention can contribute to the enhanced life and the improved performance.

Further, the rolling element of the present invention can be applied to a toroidal CVT including input and output disks and a power roller interposed between the input and output disks in contact therewith via a lubricating oil. The input and output disks and the power roller have rolling contact portions coming into rolling contact with each other during rotation thereof. Nickel coat N can be formed on the rolling contact portions of at least one of the power roller and the input and output disks. Specifically, the input and output disks and the power roller have traction surfaces coming into rolling contact with each other during rotation thereof. The traction surfaces of the input and output disks come into rolling contact with the traction surface of the power roller during rotation thereof. traction surfaces of the input and output disks. Nickel coat N can be formed on at least one of the traction surface of the power roller and the traction surfaces of the input and output disks. Further, the power roller has bearing groove surfaces on outer and inner races thereof. The bearing groove surfaces define grooves for receiving a plurality of rolling members such as balls thereon, and come into rolling contact with the rolling members during rotation of the power roller. Nickel coat N can be formed on at least the bearing groove surfaces of the outer and inner races of the power roller.

Figure 2:
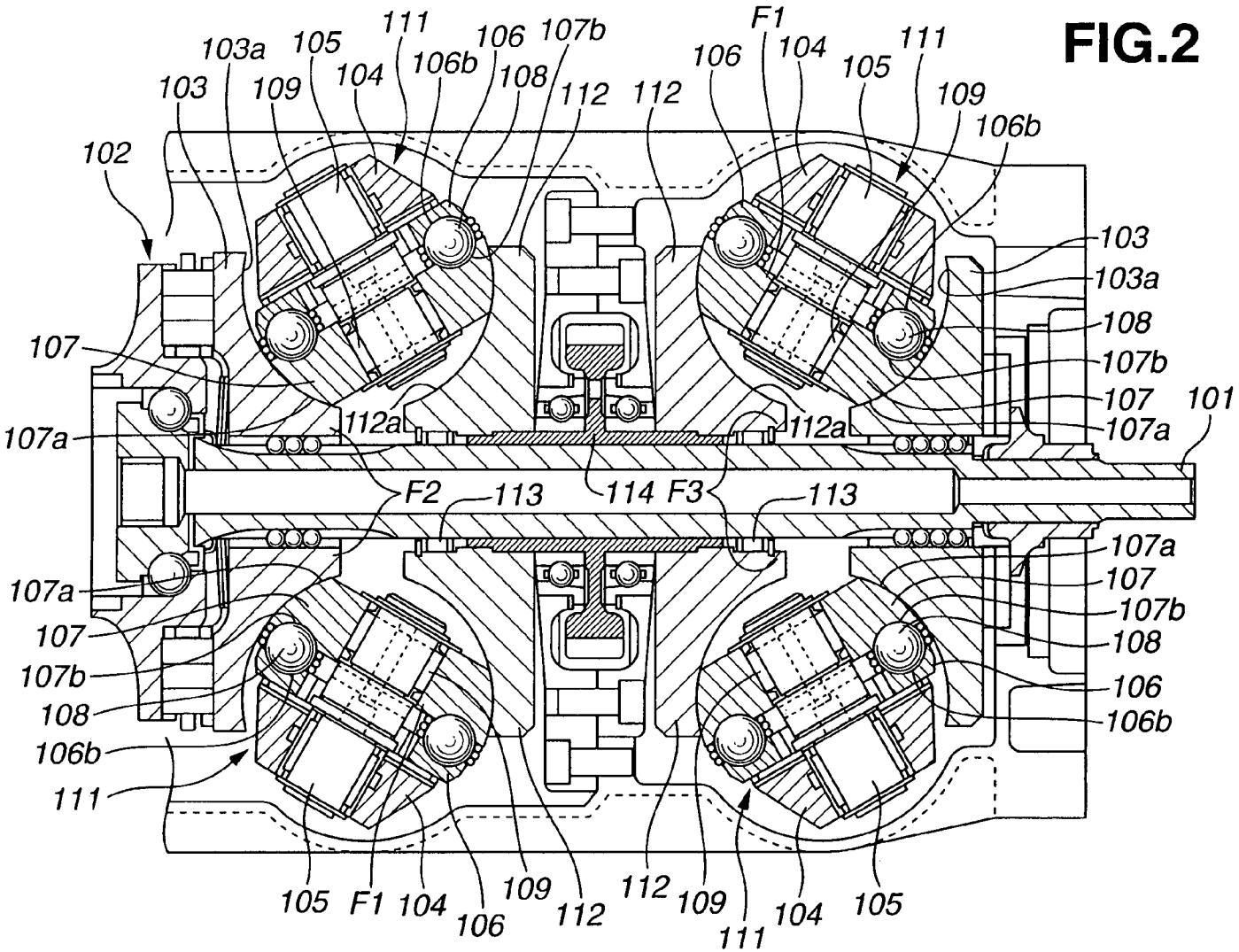
FIG. 2 is a sectional view of a toroidal continuously variable transmission (CVT) to which the rolling element of the present invention is applicable.

Referring to FIG. 2, there is shown a toroidal continuously variable transmission (CVT) to which the rolling element of the present invention can be applied. As illustrated in FIG. 2, the toroidal CVT includes input shaft 101 connected to an engine, input disk 103 rotatable about an axis thereof and axially moveable within a predetermined range, and output disk 112 rotatable about an axis thereof. Input disk 103 and output disk 112 have substantially the same shape are arranged in coaxial and symmetrical relation to each other as shown in FIG. 2. Loading cam device 102 applies a loading force to input disk 103 toward output disk 112. A pair of power rollers 111 are interposed between input and output disks 103 and 112 in contact with input and output disks 103 and 112 via a lubricating oil. The toroidal CVT has two units including input and output disks 103 and 112 and the pair of power rollers 111.

Specifically, input disk 103 and output disk 112 have traction surface 103*a* and traction surface 112*a*, respectively. Traction surfaces 103*a* and 112*a* are axially opposed to and spaced from each other to form a toroidal surface. Each of power rollers 111 includes trunnion 104 and pivot shaft 105 mounted to trunnion 104. Outer race 106 is fixed to pivot shaft 105. Inner race 107 is mounted to pivot shaft 105 through radial needle bearing 109 so as to be rotatable about an axis of pivot shaft 105. Inner race 107 has traction surface 107*a* contacted with traction surface 103*a* of input disk 103 and traction surface 112*a* of output disk 112 via the lubricating oil. A plurality of rolling members 108, in the form of balls, are interposed between outer and inner races 106 and 107 in contact therewith via the lubricating oil. Outer and inner races 106 and 107 include bearing groove surfaces 106*b* and 107*b* that define grooves for receiving rolling members 108, respectively. Output disk 112 is connected with input shaft 101 via radial needle bearing 113 and coupled to output gear 114 rotatable about an axis of input shaft 101.

When input shaft 101 rotates, input disk 103 is rotated via loading cam device 102. As input disk 103 is rotated, inner races 107 of the pair of power rollers 111 come into rolling contact with both traction surface 103*a* of input disk 103 and traction surface 112*a* of output disk 112. Output disk 112 then is rotated together with output gear 114. Thus, rotation of input shaft 101 is transmitted to output gear 114. During the transmission of rotation from input shaft 101 to output gear 114, trunnions 104 with inner races 107 of power rollers 111 are rotated about pivots, not shown, so as to swing inner races 107 relative to input and output disks 103 and 112. As a result, the contact between inner races 107 and traction surfaces 103*a* and 112*a* of input and output disks 103 and 112 is displaced. Namely, the effective radiuses of input and output disks 103 and 112 are varied, so that the speed ratio are continuously varied.

Upon the rotation transmission of the thus-constructed toroidal CVT, input and output disks 103 and 112 and each power roller 111 act as the rolling elements and have rolling contact portions coming into rolling contact with each other and bending stress-applied portions considerably undergoing bending stress. The rolling contact portions are located on traction surfaces 103*a* and 112*a* of input and output disks 103 and 112, traction surface 107*b* of inner race 107 of power roller 111, bearing groove surfaces 106*b* and 107*b* of outer and inner races 106 and 107 of power roller 111, radial needle bearing 109 between pivot shaft 105 and inner race 107 of power roller 111, and radial needle bearing 113 between input shaft 101 and output disk 112. The bending stress-applied portions are, for instance, inner circumferential portion F1 of outer race 106 of power roller 111, and small-diameter portions F2 and F3 of input and output disks 103 and 112.

In a case where the rolling element of the present invention is applied to the above-described toroidal CVT, nickel coat N can be formed on a part or all of the rolling contact portions as explained above. With the provision of nickel coat N on the rolling contact portions, reduction of microscopic metal-to-metal contact and suppression of hydrogen infiltration into base metal M can be achieved, so that rolling-fatigue strength at the rolling contact portions will be significantly improved. This can maintain excellent performance of the rolling element for a long period of use, and therefore, durability of the toroidal CVT can be remarkably enhanced. Further, the units of the toroidal CVT can be adjusted in volume and size. Meanwhile, in the case of applying the rolling element of the present invention to the toroidal CVT, nickel coat N can be also formed on bearings other than the rolling contact portions as described above.

Further, in the case of applying the rolling element of the present invention to the toroidal CVT, nickel coat N can be formed on a part or all of at least one of traction surface 107*a* of inner race 107 of power roller 111 and traction surfaces 103*a* and 112*a* of input and output disks 103 and 112. With the provision of nickel coat N on traction surface 107*a* and traction surfaces 103*a* and 112*a*, reduction of microscopic metal-to-metal contact and suppression of hydrogen infiltration into base metal M can be achieved. Therefore, rolling-fatigue strength on traction surface 107*a* and traction surfaces 103*a* and 112*a* will be significantly improved, and excellent performance thereof will be maintained. As a result, durability of the toroidal CVT can be remarkably enhanced, and the units of the toroidal CVT can be adjusted in volume and size.

Further, in the case of applying the rolling element of the present invention to the toroidal CVT, nickel coat N can be formed on at least bearing groove surfaces 106*b* and 107*b* of outer and inner races 106 and 107 of power roller 111 which undergo high temperature and high contact surface pressure. With the provision of nickel coat N on bearing groove surfaces 106*b* and 107*b*, reduction of microscopic metal-to-metal contact and suppression of hydrogen infiltration into base metal M can be achieved. Therefore, excellent property of nickel coat N will be sustainably obtained to thereby significantly improve rolling-fatigue strength on bearing groove surfaces 106*b* and 107*b*. As a result, durability of the toroidal CVT can be remarkably enhanced, and the units of the toroidal CVT can be adjusted in volume and size.

Figure 3A:
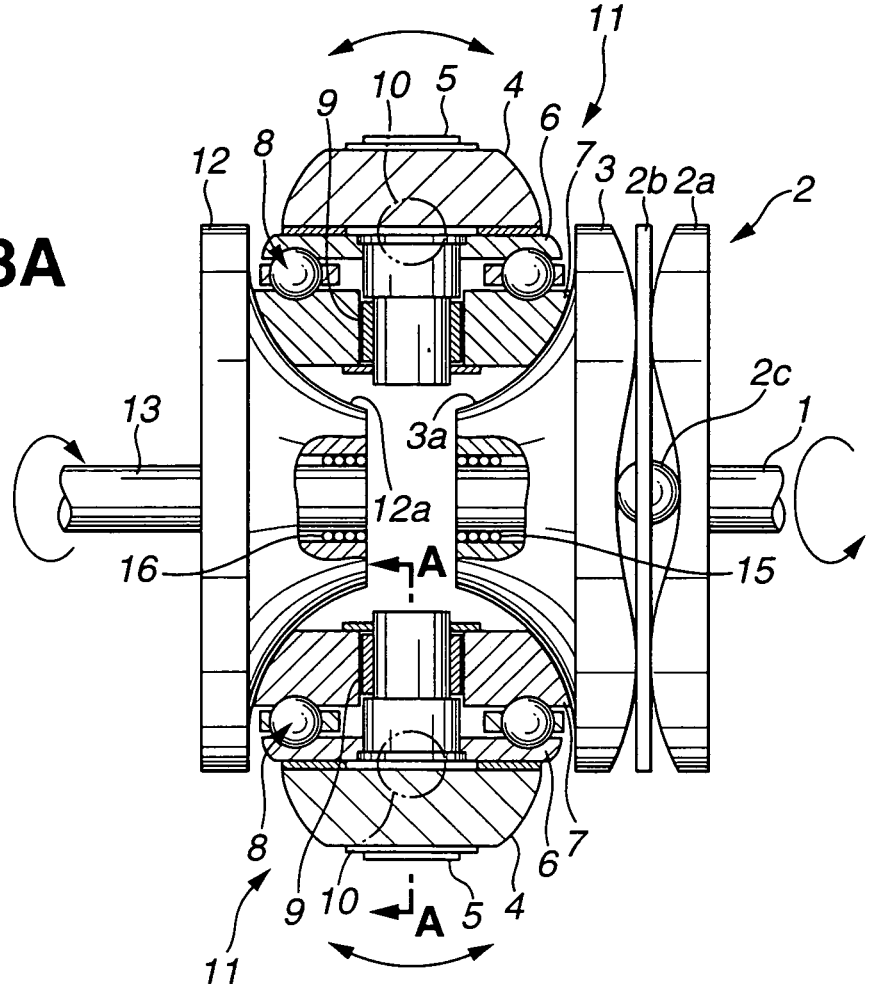
FIG. 3A is a partially sectional view of a toroidal CVT, showing input and output disks and power rollers therebetween.

Referring to FIG. 3A, a rolling element of a second embodiment of the present invention will be explained hereinafter, which is incorporated to a toroidal CVT. As illustrated in FIG. 3A, the toroidal CVT includes input shaft 1, loading cam device 2, input disk 3, a pair of power rollers 11, output disk 12 and output shaft 13. Loading cam device 2 includes cam plate 2*a*, retainer 2*b* and cam roller 2*c*, through which input disk 3 is connected with input shaft 1. Output disk 12 is fixed to output shaft 13. Input and output disks 3 and 12 have traction surfaces 3*a* and 12*a* that are axially opposed to and spaced from each other and form a toroidal surface. Power rollers 11 are interposed between input and output disks 3 and 12 in contact therewith via a lubricating oil.

Each of power rollers 11 includes trunnion 4, pivot shaft 5 mounted to trunnion 4, outer race 6 fixed to pivot shaft 5, and inner race 7 rotatably mounted to pivot shaft 5 through a plurality of rolling members 8 and radial needle bearing 9. Inner race 7 has traction surface 7*b* contacted with traction surface 3*a* of input disk 3 and traction surface 12*a* of output disk 12 via the lubricating oil. Rolling members 8 are in the form of balls and interposed between outer and inner races 6 and 7 in contact therewith via the lubricating oil. Outer and inner races 6 and 7 include bearing groove surfaces 6*a* and 7*a* that define grooves for receiving rolling members 8, respectively.

When input shaft 1 rotates, input disk 3 is rotated via loading cam device 2. As input disk 3 is rotated, inner races 7 of power rollers 11 come into rolling contact with both traction surface 3*a* of input disk 3 and traction surface 12*a* of output disk 12. Output disk 12 is rotated together with output shaft 13. Thus, rotation of input shaft 1 is transmitted to output shaft 13. During the transmission of rotation from input shaft 1 to output shaft 13, trunnions 4 with inner races 7 of power rollers 11 are rotated about pivots 10 as indicated by phantom line in FIG. 3A, so as to swing inner races 7 relative to input and output disks 3 and 12. As a result, the contact between traction surface 7*b* of each of inner races 7 and traction surfaces 3*a* and 12*a* of input and output disks 3 and 12 is displaced. Thus, the effective radiuses of input and output disks 3 and 12 are varied, so that the speed ratio are continuously varied.

In the thus-constructed toroidal CVT, input and output disks 3 and 12 and each of power rollers 11 act as the rolling elements. Input and output disks 3 and 12 have rolling contact portions coming into rolling contact with power roller 11, and power roller 11 has rolling contact portion coming into rolling contact with input and output disks 3 and 12. Nickel coat N having the same structure and properties as explained in the first embodiment is formed on at least one of rolling contact portions of input and output disks 3 and 12 and power roller 11. Specifically, the rolling contact portions are disposed on traction surfaces 3*a* and 12*a* of input and output disks 3 and 12, traction surface 7*b* of inner race 7 of power roller 11, and bearing groove surfaces 6*a* and 7*a* of outer and inner races 6 and 7 of power roller 11. Nickel coat N having the same structure and properties as explained in the first embodiment is formed on at least one of traction surface 7*b* of inner race 7 of power roller 11, traction surfaces 3*a* and 12*a* of input and output disks 3 and 12, and bearing groove surfaces 6*a* and 7*a* of outer and inner races 6 and 7 of power roller 11.

Figure 3B:
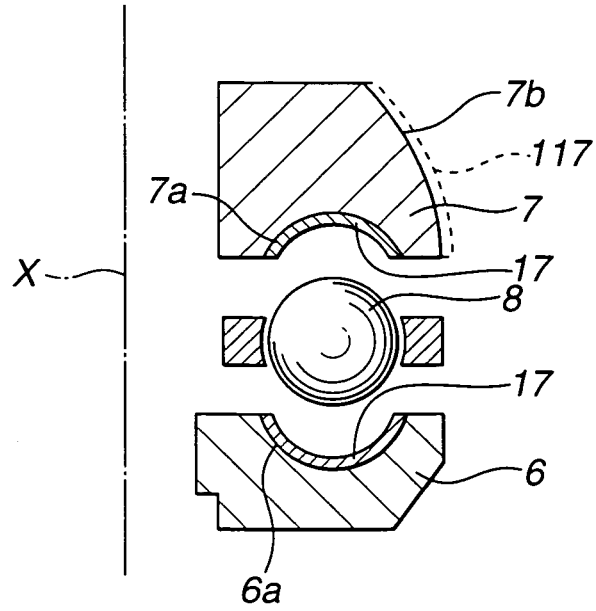
FIG. 3B is an enlarged and exploded sectional view of the power roller, taken along line A-A of FIG. 3A, showing a right half of inner and outer races and nickel coats formed on the inner and outer races.

FIG. 3B shows an exploded sectional view of only the right half of power roller 11 of FIG. 3A relative to rotation axis X of power roller 11. In FIG. 3B, reference numeral 17 denotes nickel coat N formed on bearing groove surfaces 6*a* and 7*a* of outer and inner races 6 and 7 of power roller 11. Further, nickel coat N can be formed on traction surface 7*b* of inner race 7 as indicated by phantom line 117 in FIG. 3B. In addition, nickel coat N can be formed on traction surfaces 3*a* and 12*a* of input and output disks 3 and 12 shown in FIG. 3A.

The rolling element of the above-described embodiments of the present invention has the following effects. The length and area of the interface between the base metal and nickel coat N formed on the rolling contact surface can be increased to thereby enhance the adhesion strength of nickel coat N relative to the base metal. This can promote diffusion of the nickel contained in nickel coat N into the base metal, and therefore, can facilitate forming a nickel diffusion layer as a protection coat preventing hydrogen from infiltrating therethrough into the base metal of the rolling element. Further, this can reduce neo-surface production caused by the microscopic metal-to-metal contact and suppress hydrogen infiltration into the inside structure of the base metal even in the severe conditions such as high temperature and high contact surface pressure. As a result, the rolling-fatigue life of the rolling element of the embodiment can be improved. In particular, the short-life flaking due to the hydrogen-induced embrittlement which is caused by infiltration of the hydrogen generated by chemical decomposition of a lubricating oil during rolling of the rolling element, into the base metal of the rolling element, can be suppressed. This can significantly increase the rolling-fatigue life of the rolling element of the embodiment and maintain the excellent property of nickel coat N for a long period of use. Therefore, the rolling element of the embodiment can exhibit a stable long-life.

A process for producing the rolling element having a rolling contact surface coming into rolling contact with a counterpart, according to the present invention will be explained hereinafter. The process includes steps of forming nickel coat N on a surface of base metal M of a workpiece, and subjecting the surface of base metal M formed with nickel coat N to baking at a temperature of not more than 200° C. to thereby provide the rolling element having the rolling contact surface as shown in FIG. 1. Namely, the rolling contact surface satisfies condition that a mean value of ratios of L1 to L2 as measured in at least three optional observation areas is in a range of from 1.2 to 2.4, where each of the at least three optional observation areas is disposed in a cross section taken in a vertical direction relative to the surface of base metal M covered with nickel coat N and is defined by two parallel lines extending in the vertical direction; L1 represents a length of an interface between base metal M and nickel coat N in each of the at least three optional observation areas; and L2 represents a length of a reference line segment extending perpendicular to the vertical direction in each of the at least three optional observation areas, L1 and L2 being present in same observation area.

By subjecting the workpiece formed with nickel coat N on base metal M to baking at a temperature of not more than 200° C., nickel contained in nickel coat N is diffused into base metal M to thereby form a nickel diffusion layer. This enhances the adhesion strength of nickel coat N relative to base metal M, so that hydrogen infiltration into base metal M will be suppressed and the rolling-fatigue life of the traction surfaces of the rolling element will be enhanced. Further, by conducting the baking treatment as described above, the effect of dehydrogenation can be maintained, and softening of base metal M and reduction of the residual stress caused in nickel coat N can be prevented. As a result, hydrogen infiltrated into base metal M or nickel coat N during the electroplating process and hydrogen infiltrated into base metal M during the heat treatment such as carburizing-and-quenching and carbonitriding-and-quenching will be removed.

If the baking treatment is conducted at a temperature of more than 200° C., the amount of the hydrogen removed will be increased, but base metal M will be softened due to the high temperature and the residual compression stress applied to base metal M by shot-peening will be reduced. Further, the baking treatment is preferably carried out within a vacuum furnace. This further enhances the effect of dehydrogenation.

By the above-described production process of the present invention, it is possible to provide the rolling element having the rolling contact surface that satisfies the following condition: a mean value of ratios of L1 to L2 as measured in at least three optional observation areas is in a range of from 1.2 to 2.4, where each of the at least three optional observation areas is disposed in a cross section taken in a vertical direction relative to the surface of base metal M covered with nickel coat N and is defined by two parallel lines extending in the vertical direction; L1 represents a length of an interface between base metal M and nickel coat N in each of the at least three optional observation areas; and L2 represents a length of a reference line segment extending perpendicular to the vertical direction in each of the at least three optional observation areas, L1 and L2 being present in same observation area. As a result, the length and area of the interface between base metal M and nickel coat N can be increased to thereby enhance the adhesion strength of nickel coat N relative to base metal M.

Further, the surface of base metal M can be subjected to acid washing before forming nickel coat N thereon. Namely, the surface of base metal M can be subjected to washing with one of an inorganic acid aqueous solution, an organic acid aqueous solution, an inorganic acid solution and an organic acid solution before forming nickel coat N on the surface of base metal M. By conducting the acid-washing treatment with the acid-based agent before forming nickel coat N on the surface of base metal M, the surface of base metal M will be roughened due to the etching function of the acid-based agent.

Further, the surface of base metal M can be subjected to shot blasting before forming nickel coat N thereon. By conducting the shot blasting process before forming nickel coat N on the surface of base metal M, the surface of base metal M will be roughened so that the same effect as described above can be obtained.

EXAMPLES

The present invention is described in more detail by way of examples and comparative examples by referring to the accompanying drawings. However, these examples are only illustrative and not intended to limit a scope of the present invention thereto.

Example 1

Test specimens of outer and inner races 6 and 7, as shown in FIG. 3B, of power roller 11 were prepared in the following manner.

A workpiece made of a steel having a chemical composition as shown in Table 1, was subjected to forging and rough machining to prepare a preform of each of outer and inner races 6 and 7.

TABLE 1

| | | C | Si | Mn | P | S | Ni | Cr | Mo |
|---|---|---|---|---|---|---|---|---|---|
| A | SCM420 | 0.20 | 0.25 | 0.80 | 0.015 | 0.009 | — | 1.1 | 0.15 |
| B | SNCM420 | 0.20 | 0.25 | 0.70 | 0.017 | 0.009 | 2.0 | 0.6 | 0.20 |
| C | SCM435 | 0.35 | 0.30 | 0.75 | 0.018 | 0.008 | — | 1.0 | 0.25 |
| D | SUJ2 | 1.00 | 0.30 | 0.50 | 0.014 | 0.007 | — | 1.5 | — |

Figure 4:
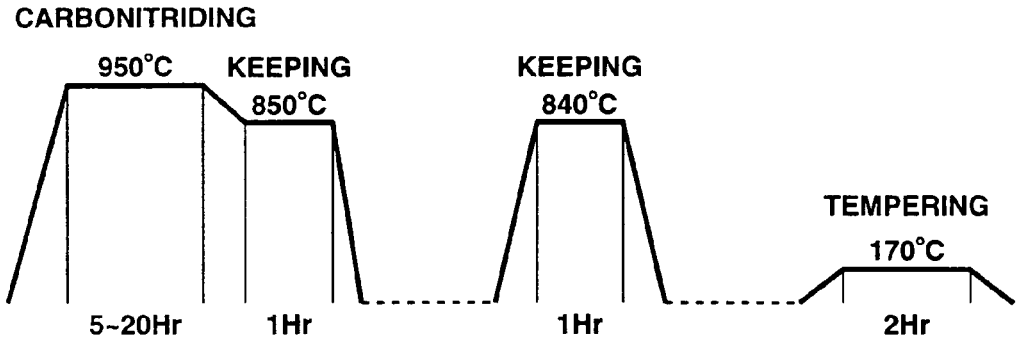
FIG. 4 is an explanatory diagram showing a heat treatment process to which test specimens used in examples are subjected.

The preform was then subjected to heat treatment as shown in FIG. 4. First, the preform was subjected to carbonitriding at 950° C. for 5 to 20 hours, kept at 850° C. for 1 hour and then subjected to oil-quenching in a 60° C. oil. Subsequently, the preform was heated at 840° C. for 1 hour and subjected to oil-quenching in a 60° C. oil. The preform was then subjected to tempering at 170° C. for 2 hours. Next, the heat-treated preform was subjected to grinding and superfinishing to form bearing groove surface 6*a* and 7*a*.

Bearing groove surface 6*a* and 7*a* was subjected to acid washing. Bearing groove surface 6*a* and 7*a* was washed with one of an inorganic acid aqueous solution, an organic acid aqueous solution, an inorganic acid solution and an organic acid solution. Subsequently, bearing groove surface 6*a* and 7*a* was subjected to nickel strike plating and then nickel plating to form a nickel coat containing nickel as a main component thereon, as indicated at 17 in FIG. 3B. Nickel coat 17 had a two-layered structure constituted of nickel strike plating layer Ns and outer nickel plating layer Nj formed on nickel strike plating layer Ns as shown in FIG. 1. The nickel strike plating and the outer nickel plating were conducted using strike plating bath A and outer nickel plating bath B, respectively. The compositions and conditions of nickel strike plating bath A and outer nickel plating bath B were as follows.

Nickel Strike Plating Bath A:

| | |
|---|---|
| nickel chloride | 200 g/L |
| hydrochloric acid | 80 g/L |
| boric acid | 30 g/L |
| pH | 1 or less |
| temperature | 50 to 55° C. |
| current density | 0.1 to 10 A/dm$^2$ |

Outer Nickel Plating Bath B:

| | |
|---|---|
| 60% nickel sulfamate | 800 g/L |
| nickel chloride | 15 g/L |
| boric acid | 45 g/L |
| saccharin soda | 5 g/L |
| 50% hypophosphorous acid | 0 to 1 g/L |
| pH | 4 to 5 |
| temperature | 55 to 60° C. |
| current density | 1 to 10 A/dm$^2$ |

Next, outer and inner races 6 and 7 formed with nickel coat 17 on bearing groove surfaces 6*a* and 7*a* were subjected to baking at the temperature of 130° C. for 20 hours within a vacuum furnace. The nickel-plated surface of the base metal had a surface roughness Ra substantially in a range of from 0.03 to 0.06.

The thus-formed test specimens of outer and inner races 6 and 7 were subjected to a rolling-fatigue test using the bearing rolling-fatigue tester shown in FIG. 5, to thereby evaluate rolling-fatigue lives of bearing groove surfaces 6*a* and 7*a*, and subjected to various measurements in the manner as explained later to thereby evaluate the properties.

Figure 5:
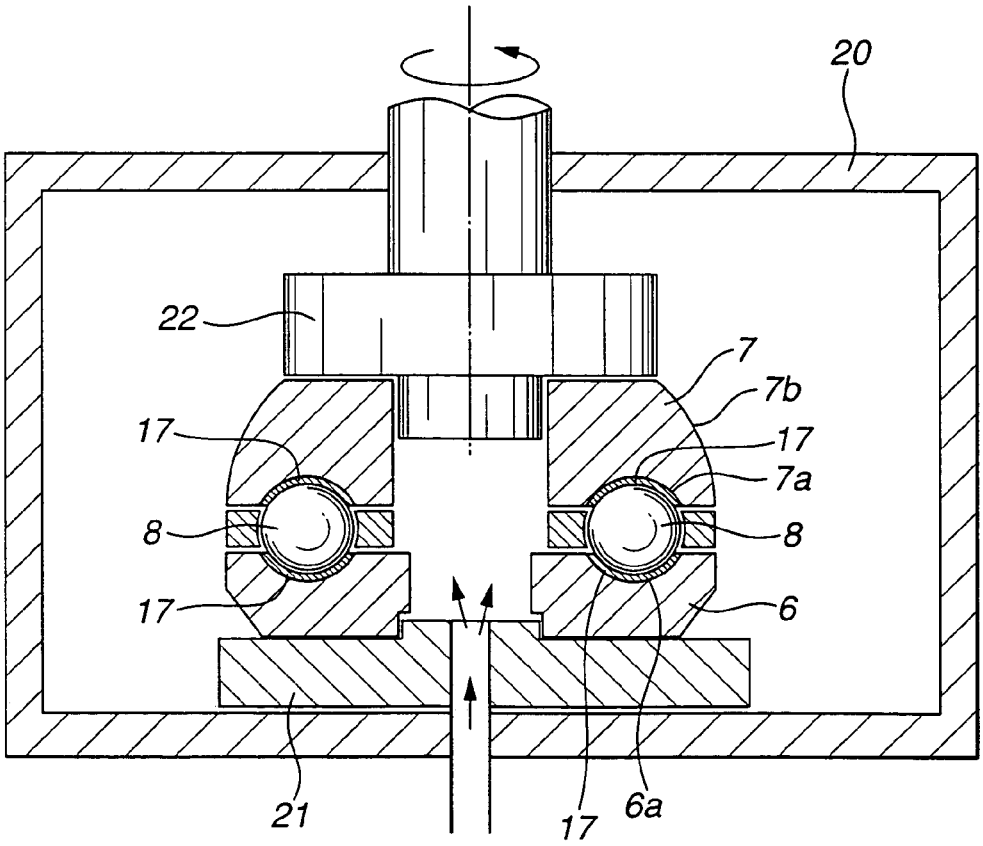
FIG. 5 is a schematic sectional view of a bearing rolling-fatigue tester used for measuring rolling-fatigue strength of the test specimens used in examples.

As illustrated in FIG. 5, the bearing rolling-fatigue tester had casing 20, base plate 21 disposed within casing 20, and rotation shaft 22 extending into casing 20. A lower surface of outer race 6 was supported by base plate 21. Rotating shaft 22 was brought into contact with an upper surface of inner race 7 by applying a predetermined force thereonto. A lubricating oil was supplied to the inside of inner race 7 via a through-hole of base plate 21 as indicated by arrows in FIG. 5. Inner race 7 was rotated with rotating shaft 22 while being supplied with the lubricating oil.

In the rolling-fatigue test, the predetermined force applied to rotating shaft 22 was set such that the maximum contact surface pressure exerted on bearing groove surfaces 6*a* and 7*a* was 3.4 GPa under forced lubrication using a traction oil as the lubricating oil, of 3 L/min. A vibration sensor was used in the measurement of rolling-fatigue lives of bearing groove surfaces 6*a* and 7*a*. The rolling-fatigue lives of bearing groove surfaces 6*a* and 7*a* were determined as the test time required for causing flaking on one of bearing groove surfaces 6*a* and 7*a*. When the rolling-fatigue lives measured reached $3.50\times10^8$, the rolling-fatigue test was finished.

The measurement for evaluating the properties of nickel coat 17 on bearing groove surfaces 6*a* and 7*a* of the test specimens was carried out as follows. The properties included minimum thickness x of nickel coat 17 formed on bearing groove surfaces 6*a* and 7*a*, and minimum thickness y of the nickel strike plating layer of nickel coat 17. Minimum thickness x and minimum thickness y were measured by observing a cross section of nickel coat 17 taken in a vertical direction relative to the surface of the base metal covered with nickel coat 17, with a scanning electron microscope (SEM) at a magnification of 10000 in three fields of view, respectively. Mean values of the measurement results of respective minimum thickness x and minimum thickness y was calculated.

The properties of nickel coat 17 further included a mean value of ratios L1/L2 of length L1 to length L2 as illustrated in FIG. 1. The mean value was calculated as a mean value of ratios L1/L2 of length L1 to length L2 which were measured in the three fields of view observed with the SEM as explained above by an image processing device. In the cross section taken in the vertical direction relative to the surface of the base metal covered with nickel coat 17, a reference line segment having the length of 11.5 μm extending in a direction perpendicular to the vertical direction relative to the surface of the base metal was determined. The ratios L1/L2 of length L1 of an interface between the base metal and nickel coat 17, to length L2 of the reference line segment were calculated in observation areas in the three fields of view. Each of the observation areas was defined by two lines La and Lb that were parallel to the vertical direction relative to the surface of the base metal and passed through opposite ends of the reference line segment as shown in FIG. 1.

The properties of nickel coat 17 further included maximum height Ry of the interface between the base metal and nickel coat 17 within the observation area. Maximum height Ry was measured in the following manner. The test specimens of outer and inner races 6 and 7 were immersed in a stripping solution LIPMASTER #1219 (trademark of a cyanogen-based break away agent made by KIZAI Co.) after completion of testing of the rolling-fatigue lives of bearing groove surfaces 6*a* and 7*a* using the bearing rolling-fatigue tester shown in FIG. 5. Only nickel coat 17 covering each of bearing groove surfaces 6*a* and 7*a* was completely chemically removed by the immersion so that the underlying base metal was exposed. Subsequently, the base metal at a non-rolling contact portion of each of bearing groove surfaces 6*a* and 7*a* was measured using a tracer-type surface roughness tester at a cutoff of 0.08 mm. The tracer-type surface roughness tester was prescribed by JIS B 0651.

Examples 2, 4-6

Test specimens of outer and inner races 6 and 7 were prepared using the same steel and method as described in Example 1. Thus-prepared test specimens of races 6 and 7 were tested and measured in the same manner as described in Example 1. The results of the test and measurements are shown in Table 2.

Examples 3, 8

Test specimens of each of races 6 and 7 were prepared using the same steel and method as described in Example 1, except that shot blasting and acid washing were conducted before forming nickel coat 17 on bearing groove surfaces 6*a* and 7*a* of races 6 and 7. Thus-prepared test specimens of races 6 and 7 were tested and measured in the same manner as described in Example 1. The results of the test and measurements are shown in Table 2.

Example 7

Test specimens of each of races 6 and 7 were prepared using the same steel and method as described in Example 1, except that shot blasting was conducted before forming nickel coat 17 on bearing groove surfaces 6*a* and 7*a* of races 6 and 7. Thus-prepared test specimens of races 6 and 7 were tested and measured in the same manner as described in Example 1. The results of the test and measurements are shown in Table 2.

Example 8

Test specimens of each of races 6 and 7 were prepared using the same steel and method as described in Example 1, except that shot blasting and acid washing were conducted before forming nickel coat 17 on bearing groove surfaces 6*a* and 7*a* of races 6 and 7, and the baking treatment after forming nickel coat 17 was omitted. Thus-prepared test specimens of races 6 and 7 were tested and measured in the same manner as described in Example 1. The results of the test and measurements are shown in Table 2.

Comparative Examples 1, 3, 5

Test specimens of outer and inner races 6 and 7 were prepared using the same steel and method as described in Example 1, except that the baking treatment after forming nickel coat 17 was omitted. Thus-prepared test specimens of races 6 and 7 were tested and measured in the same manner as described in Example 1. The results of the test and measurements are shown in Table 2.

Comparative Example 2

Test specimens of each of races 6 and 7 were prepared using the same steel and method as described in Example 1, except that shot blasting was conducted before forming nickel coat 17 on bearing groove surfaces 6*a* and 7*a* of races 6 and 7, and the baking treatment after forming nickel coat 17 was omitted. Thus-prepared test specimens of races 6 and 7 were tested and measured in the same manner as described in Example 1. The results of the test and measurements are shown in Table 2.

Comparative Examples 4, 6

Test specimens of each of races 6 and 7 were prepared using the same steel and method as described in Example 1, except that shot blasting and acid washing were conducted before forming nickel coat 17 on bearing groove surfaces 6*a* and 7*a* of races 6 and 7, and the baking treatment after forming nickel coat 17 was omitted. Thus-prepared test specimens of races 6 and 7 were tested and measured in the same manner as described in Example 1. The results of the test and measurements are shown in Table 2.

TABLE 2

| | | Production process | | | Properties of Ni coat | | | | |
|---|---|---|---|---|---|---|---|---|---|
| | Steel kind | Pretreatment | Plating condition | Baking condition | Ratio of interface length to reference line segment | Ni coat thickness x | Ni strike plating layer thickness y | Maximum height Ry of interface | Rolling-fatigue life cycle |
| Example 1 | A | Acid washing | Ni strike plating bath A + Outer Ni plating bath B | 130° C. for 20 hours | 1.81 | 7.2 | 1.2 | 0.3 | 3.50E+08 |
| Example 2 | B | Acid washing | Ni strike plating bath A + Outer Ni plating bath B | 130° C. for 20 hours | 1.22 | 3.2 | 0.5 | 0.05 | 3.50E+08 |
| Example 3 | C | Shot blasting + Acid washing | Ni strike plating bath A + Outer Ni plating bath B | 130° C. for 20 hours | 1.58 | 8.8 | 0.3 | 0.2 | 3.50E+08 |
| Example 4 | D | Acid washing | Ni strike plating bath A + Outer Ni plating bath B | 130° C. for 20 hours | 1.43 | 4.2 | 1.0 | 0.6 | 3.50E+08 |
| Example 5 | A | Acid washing | Ni strike plating bath A + Outer Ni plating bath B | 130° C. for 20 hours | 2.34 | 4.8 | 0.7 | 0.2 | 2.20E+08 |
| Example 6 | A | Acid washing | Ni strike plating bath A + Outer Ni plating bath B | 130° C. for 20 hours | 1.95 | 9.8 | 2.4 | 0.8 | 1.02E+08 |
| Example 7 | A | Shot blasting | Ni strike plating bath A + Outer Ni plating bath B | 130° C. for 20 hours | 1.46 | 2.1 | 0.8 | 0.1 | 1.35E+08 |
| Example 8 | A | Shot blasting + Acid washing | Ni strike plating bath A + Outer Ni plating bath B | None | 1.52 | 8.7 | 1.6 | 0.4 | 2.01E+08 |
| Comparative Example 1 | A | Acid washing | Ni strike plating bath A + Outer Ni plating bath B | None | 1.11 | 2.2 | 0.1 | 0.03 | 4.20E+07 |
| Comparative Example 2 | A | Shot blasting | Ni strike plating bath A + Outer Ni plating bath B | None | 2.98 | 1.7 | 0.5 | 0.05 | 4.60E+07 |
| Comparative Example 3 | A | Acid washing | Ni strike plating bath A + Outer Ni plating bath B | None | 2.54 | 12.5 | 4.5 | 2.3 | 4.50E+07 |
| Comparative Example 4 | B | Shot blasting + Acid washing | Ni strike plating bath A + Outer Ni plating bath B | None | 1.15 | 13.8 | 1.5 | 1.3 | 3.10E+07 |
| Comparative Example 5 | C | Acid washing | Ni strike plating bath A + Outer Ni plating bath B | None | 1.10 | 1.2 | 0.6 | 0.3 | 2.80E+07 |
| Comparative Example 6 | D | Shot blasting + Acid washing | Ni strike plating bath A + Outer Ni plating bath B | None | 2.68 | 2.3 | 0.1 | 0.7 | 2.90E+07 |

As seen from Table 2, the test specimens of Examples 1-8 exhibited the mean value of ratios L1/L2 of length L1 of the interface between the base metal and nickel coat 17 to length L2 of the reference line segment within the observation areas in the three fields of views nickel, in the range of from 1.2 to 2.4. The test specimens of Examples 1-8 exhibited maximum height Ry of the interface in the range of from 0.05 μm to 1 μm. The test specimens of Examples 1-8 exhibited minimum thickness x of nickel coat 17 in the range of from 2 μm to 10 μm, and minimum thickness y of the nickel strike plating layer in the range of 0.2 μm or more. Further, the test specimens of Examples 1-8 exhibited the rolling-fatigue lives significantly increased as compared with those of the test specimens of Comparative Examples 1-6. It was recognized that the test specimens of Examples 1-8 were prevented from suffering from the short-life flaking due to hydrogen-induced embrittlement, by conducting the baking treatment after forming nickel coat 17. As a result, the significant increase in rolling-fatigue lives of the test specimens of Examples 1-8 can be attained for a long period of use.

Further, it was recognized that the test specimens of Examples 5-8 were prevented from suffering from the short-life flaking due to hydrogen-induced embrittlement. Although the test specimens of Examples 5-8 exhibited white etching constituent (WEC) flaking due to the material composition or the heat treatment as well as life of the material itself, the rolling-fatigue lives thereof were increased about 3 to 7 times as compared with those of the test specimens of Comparative Examples 1-6.

This application is based on a prior Japanese Patent Application No. 2004-157028 filed on May 27, 2004, the entire contents of which is hereby incorporated by reference.

Although the invention has been described above by reference to embodiments and examples of the invention, the invention is not limited to the embodiments and examples described above. Modifications and variations of the embodiments and examples described above will occur to those skilled in the art in light of the above teachings. The scope of the invention is defined with reference to the following claims.

What is claimed is:

1. A rolling element having a rolling contact surface coming into rolling contact with a counterpart, the rolling element comprising:

a base metal; and a nickel coat formed on a surface of the base metal and cooperating with the base metal to constitute the rolling contact surface, wherein the rolling contact surface satisfies condition that a mean value of ratios of L1 to L2 as measured in at least three optional observation areas is in a range of from 1.2 to 2.4, where each of the at least three optional observation areas is disposed in a cross section taken in a vertical direction relative to the surface of the base metal covered with the nickel coat and is defined by two parallel lines extending in the vertical direction; L1 represents a length of an interface between the base metal and the nickel coat in each of the at least three optional observation areas; and L2 represents a length of a reference line segment extending perpendicular to the vertical direction in each of the at least three optional observation areas, L1 and L2 being present in same observation area.

2. The rolling element as claimed in claim 1, wherein a maximum height Ry of the interface between the base metal and the nickel coat within the observation area is in a range of from 0.05 μm to 1 μm.

3. The rolling element as claimed in claim 1, wherein the nickel coat comprises a two-layered structure constituted of a nickel strike plating layer and an outer nickel plating layer formed on the nickel strike plating layer.

4. The rolling element as claimed in claim 1, wherein a minimum thickness of the nickel coat within the observation area is in a range of from 2 μm to 10 μm.

5. The rolling element as claimed in claim 3, wherein a minimum thickness of the nickel strike plating layer within the observation area is in a range of 0.2 μm or more.

6. The rolling element as claimed in claim 1, wherein the rolling element is applied to at least one of a rolling element and bearing for a toroidal continuously variable transmission, a bearing for a belt-drive continuously variable transmission, and a gear and bearing for an engine driving auxiliary machinery.

7. The rolling element as claimed in claim 1, wherein the rolling element is applied to a toroidal continuously variable transmission including input and output disks and a power roller interposed between the input and output disks in contact therewith via lubricating oil, the input and output disks and the power roller having rolling contact portions coming into rolling contact with each other, the nickel coat being formed on at least one of the rolling contact portion of the power roller and the rolling contact portions of the input and output disks.

8. The rolling element as claimed in claim 1, wherein the rolling element is applied to a toroidal continuously variable transmission including input and output disks and a power roller interposed between the input and output disks in contact therewith via lubricating oil, the input and output disks and the power roller having traction surfaces each acting as the rolling contact surface, the nickel coat being formed on at least one of the traction surface of the power roller and the traction surfaces of the input and output disks.

9. The rolling element as claimed in claim 8, wherein the traction surfaces of the input and output disks are axially spaced from each other, the power roller including an inner race, an outer race and a plurality of rolling members interposed between the inner and outer races, the traction surface of the power roller being disposed on the inner race and coming into rolling contact with the traction surfaces of the input and output disks.

10. The rolling element as claimed in claim 1, wherein the rolling element is applied to a toroidal continuously variable transmission including input and output disks and a power roller interposed between the input and output disks in contact therewith via lubricating oil, the power roller having bearing groove surfaces acting as the rolling contact surface, the nickel coat being formed on at least the bearing groove surfaces.

11. The rolling element as claimed in claim 10, wherein the power roller comprises an inner race, an outer race and a plurality of rolling members interposed between the inner and outer races, the bearing groove surfaces being disposed on the inner race and the outer race and defining a groove receiving the plurality of rolling members, the bearing groove surfaces coming into rolling contact with the plurality of rolling members.

12. A continuously variable transmission including input and output disks and a power roller interposed between the input and output disks in contact therewith via lubricating oil, to which a rolling element as claimed in claim 1 is applied, wherein the input and output disks and the power roller have rolling contact portions coming into rolling contact with each other, the nickel coat being formed on at least one of the rolling contact portion of the power roller and the rolling contact portions of the input and output disks.

13. The continuously variable transmission as claimed in claim 12, wherein the input and output disks and the power roller have traction surfaces each acting as the rolling contact surface, the nickel coat being formed on at least one of the traction surface of the power roller and the traction surfaces of the input and output disks.

14. The continuously variable transmission as claimed in claim 13, wherein the traction surfaces of the input and output disks are axially spaced from each other, the power roller including an inner race, an outer race and a plurality of rolling members interposed between the inner and outer races, the traction surface of the power roller being disposed on the inner race and coming into rolling contact with the traction surfaces of the input and output disks.

15. The continuously variable transmission as claimed in claim 12, wherein the rolling element is applied to a toroidal continuously variable transmission including input and output disks and a power roller interposed between the input and output disks in contact therewith via lubricating oil, the power roller having bearing groove surfaces acting as the rolling contact surface, the nickel coat being formed on at least the bearing groove surfaces.

16. The continuously variable transmission as claimed in claim 15, wherein the power roller comprises an inner race, an outer race and a plurality of rolling members interposed between the inner and outer races, the bearing groove surfaces being disposed on the inner race and the outer race and defining a groove receiving the plurality of rolling members, the bearing groove surfaces coming into rolling contact with the plurality of rolling members.

17. A process for producing a rolling element having a rolling contact surface coming into rolling contact with a counterpart, the process comprising:

forming a nickel coat on a surface of a base metal of a workpiece; and subjecting the workpiece formed with the nickel coat on the surface of the base metal to baking at a temperature of not more than 200° C. to provide the rolling element having the rolling contact surface, wherein the rolling contact surface satisfies condition that a mean value of ratios of L1 to L2 as measured in at least three optional observation areas is in a range of from 1.2 to 2.4, where each of the at least three optional observation areas is disposed in a cross section taken in a vertical direction relative to the surface of the base metal covered with the nickel coat and is defined by two parallel lines extending in the vertical direction; L1 represents a length of an interface between the base metal and the nickel coat in each of the at least three optional observation areas; and L2 represents a length of a reference line segment extending perpendicular to the vertical direction in each of the at least three optional observation areas, L1 and L2 being present in same observation area.

18. The process as claimed in claim 17, further comprising subjecting the surface of the base metal to washing with one of an inorganic acid aqueous solution, an organic acid aqueous solution, an inorganic acid solution, and an organic acid solution before forming the nickel coat on the surface of the base metal.

19. The process as claimed in claim 17, further comprising subjecting the surface of the base metal to shot blasting before forming the nickel coat on the surface of the base metal.

20. The process as claimed in claim 18, further comprising subjecting the surface of the base metal to shot blasting before forming the nickel coat on the surface of the base metal.

21. The process as claimed in claim 17, wherein the nickel coat forming step comprises forming a nickel strike plating layer on the surface of the base metal, and forming an outer nickel plating layer formed on the nickel strike plating layer.

22. The process as claimed in claim 17, further comprising subjecting the workpiece to forging and rough machining to form a preform, subjecting the preform to heat treatment, and subjecting the heat-treated preform to grinding and superfinishing to form the rolling contact surface.

23. The process as claimed in claim 17, wherein the heat treatment comprises carbonitriding.

* * * * *